US010383442B2

(12) United States Patent
Lawson

(10) Patent No.: US 10,383,442 B2
(45) Date of Patent: Aug. 20, 2019

(54) STOP MECHANISM FOR RECLINER CHAIR

(71) Applicant: L&P PROPERTY MANAGEMENT COMPANY, South Gate, CA (US)

(72) Inventor: Gregory Mark Lawson, Tupelo, MS (US)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 38 days.

(21) Appl. No.: 15/660,560

(22) Filed: Jul. 26, 2017

(65) Prior Publication Data

US 2018/0242740 A1 Aug. 30, 2018

Related U.S. Application Data

(60) Provisional application No. 62/464,531, filed on Feb. 28, 2017.

(51) Int. Cl.

| | |
|---|---|
| ***A47C 3/03*** | (2006.01) |
| ***A47C 1/035*** | (2006.01) |
| ***A47C 1/024*** | (2006.01) |
| ***A47C 1/034*** | (2006.01) |
| *A47C 1/00* | (2006.01) |

(52) U.S. Cl.

CPC ..... *A47C 1/024* (2013.01); *A47C 1/0345* (2013.01); *A47C 1/00* (2013.01)

(58) Field of Classification Search

CPC ..... A45C 1/0355; A45C 1/342; A45C 1/0352; A45C 1/024; A45C 3/00

See application file for complete search history.

(56) References Cited

U.S. PATENT DOCUMENTS 3,492,049 A * 1/1970 Fletcher ..... A47C 1/0355 297/316
3,768,859 A * 10/1973 Rogers, Jr. ..... A47C 1/0355 297/69
4,337,977 A * 7/1982 Rogers, Jr. ..... A47C 1/0355 297/322

(Continued)

FOREIGN PATENT DOCUMENTS

CN 203106376 U 8/2013
WO 2015148484 A1 10/2015

(Continued)

OTHER PUBLICATIONS

International Search Report and Written Opinion dated Mar. 5, 2018 in International Patent Application No. PCT/US17/68498, 14 pages.

*Primary Examiner* — Shin H Kim
(74) *Attorney, Agent, or Firm* — Shook, Hardy & Bacon, LLP

(57) ABSTRACT

A reclining mechanism for a seating unit including a base, a linkage mechanism operatively coupled to the base, the linkage mechanism configured to move between a closed position and one or more open positions, and a stop member configured to contact the linkage mechanism and the base when the linkage mechanism is in the closed position. The linkage mechanism may include a forward pivot link pivotally connected to the base. The stop member may include a pin coupled to one of the base and the forward pivot link and may contact the other of the base and the forward pivot link when the linkage mechanism is in the closed position.

18 Claims, 5 Drawing Sheets

(56) References Cited

U.S. PATENT DOCUMENTS 7,021,711 B1 * 4/2006 Hoffman ..... A47C 1/0355 297/270.1
7,147,278 B2 * 12/2006 Johnson ..... A47C 1/0355 297/85 R
7,413,245 B2 * 8/2008 Johnson ..... A47C 1/0352 297/85 L
7,997,644 B2 * 8/2011 Hoffman ..... A47C 3/0255 297/344.21
8,016,348 B2 * 9/2011 Hoffman ..... A47C 3/0255 297/85 M
8,113,574 B2 * 2/2012 Hoffman ..... A47C 1/0355 297/362.11
8,297,693 B2 * 10/2012 Hoffman ..... A47C 3/0255 297/85 M
8,398,169 B2 * 3/2013 LaPointe ..... A47C 1/0355 297/260.2
8,449,027 B2 * 5/2013 Wiecek ..... A47C 1/0342 297/75
8,459,733 B2 * 6/2013 Hoffman ..... A47C 1/0355 297/362.11
8,517,463 B2 * 8/2013 Murphy ..... A47C 1/0355 297/270.1
8,573,687 B2 * 11/2013 Lawson ..... A47C 1/0355 297/84
8,616,627 B2 * 12/2013 Murphy ..... A47C 1/0355 297/271.1
8,657,375 B2 * 2/2014 LaPointe ..... A47C 3/025 297/258.1
8,696,054 B2 * 4/2014 Crum ..... A47C 1/0355 297/83
8,757,712 B2 * 6/2014 Wiecek ..... A47C 1/0342 297/75
8,911,009 B2 * 12/2014 Hoffman ..... A47C 1/03266 297/75
2004/0000803 A1 1/2004 Guillot
2006/0061147 A1 * 3/2006 Johnson ..... A47C 1/0355 297/85 L
2007/0046075 A1 * 3/2007 Johnson ..... A47C 1/0355 297/85 L
2010/0127538 A1 * 5/2010 Hoffman ..... A47C 1/0355 297/68
2010/0127555 A1 * 5/2010 Hoffman ..... A47C 1/0355 297/85 M
2010/0127556 A1 * 5/2010 Hoffman ..... A47C 1/0355 297/85 R
2011/0018331 A1 * 1/2011 Murphy ..... A47C 1/0355 297/85 R
2011/0233972 A1 * 9/2011 Weicek ..... A47C 1/0342 297/84
2011/0248529 A1 * 10/2011 LaPointe ..... A47C 1/0355 297/68
2011/0248536 A1 * 10/2011 LaPointe ..... A47C 1/0355 297/273
2012/0049606 A1 * 3/2012 Lawson ..... A47C 1/0355 297/85 M
2012/0112518 A1 * 5/2012 Murphy ..... A47C 1/0355 297/85 L
2012/0112519 A1 * 5/2012 Murphy ..... A47C 1/0355 297/85 M
2012/0119547 A1 * 5/2012 Hoffman ..... A47C 1/0355 297/84
2012/0146364 A1 * 6/2012 Hoffman ..... A47C 1/03266 297/84
2012/0299363 A1 * 11/2012 Crum ..... A47C 1/0355 297/85 M
2013/0257111 A1 * 10/2013 Wiecek ..... A47C 1/0342 297/84
2014/0049084 A1 * 2/2014 Lawson ..... A47C 1/032 297/340

FOREIGN PATENT DOCUMENTS

WO 2016060744 A1 4/2016
WO 2016061317 A1 4/2016

* cited by examiner

STOP MECHANISM FOR RECLINER CHAIR

CROSS-REFERENCE TO RELATED APPLICATIONS

This application claims priority to U.S. Provisional Application No. 62/464,531 filed Feb. 28, 2017. The entirety of the aforementioned application is incorporated by reference herein.

BACKGROUND

Recliners are generally well known in the furniture industry. The term recliner is used throughout this description to describe articles of furniture that include a reclining mechanism. Generally, recliners are chairs that allow the user to recline and are equipped with extendable footrests. Recliners are often in the form of a plush chair, however, they might also take the form of an oversized seat, a seat-and-a-half, a love seat, a sofa, a sectional, and the like. Recliners are known in both a manual configuration (where the user releases the reclining mechanism from a closed position to a TV position, and moves the reclining mechanism from the TV position to a full recline position) and a motorized version (where a motor is used to move the mechanism between the various positions).

The reclining motion is achieved in recliners with a linkage mechanism that is coupled to a base. The linkage mechanisms found in recliners in the art include a plurality of interconnected links that provide one or more mechanisms for extending a footrest, reclining the recliner, and obstructing movements of the chair when in specific orientations. Typically, recliners known in the art provide three positions: an upright seated position with the footrest retracted beneath the chair (the "closed position"); a television viewing position in which the chair back is slightly reclined but still provides a generally upright position with the footrest extended (the "TV position"), and a full-recline position in which the chair back is reclined an additional amount farther than in the TV position but still generally inclined with respect to the seat of the chair and with the footrest extended (the "fully reclined position").

These types of prior art recliner mechanisms, while functional, suffer from a number of drawbacks. One of which includes a problem with slack in the linkage mechanism when the chair is in the closed position. Slack in the linkage mechanism results in movement of various portions of the chair (e.g., seat and/or back) when a user sits in the chair in the closed position. It would be desirable to provide a recliner, whether manual or motorized, having an improved stop mechanism that reduces slack in the linkage mechanism when the chair is in the closed position.

BRIEF SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section. This summary is not intended to identify key features or essential features of the claimed subject matter, nor is it intended to be used as an aid in isolation to determine the scope of the claimed subject matter.

At a high level, this disclosure relates to an improved stop mechanism for recliners. The improved stop mechanism reduces slack in the linkage mechanism when the chair is in the closed position. The stop mechanism may include a pin coupled to the linkage mechanism or the base and a mating stop surface formed on the other of the linkage mechanism or the base opposite the pin. When the chair is in the closed position, the pin contacts the mating stop surface and halts further movement of the linkage mechanism in a first direction. The stop mechanism may further include one or more additional pins coupled to various portions of the linkage mechanism and paired with one or more additional mating stop surfaces formed on various other portions of the linkage mechanism. When the chair is in the closed position, the one or more additional pins each contact a respective mating stop surface of the one or more additional mating stop surfaces and halts further movement of the linkage mechanism in the first direction.

In an embodiment of the invention, a recline mechanism for use in reclining furniture is described. The recline mechanism may include a base, a linkage mechanism, and a stop member. The linkage mechanism may be operatively coupled to the base and configured to move between a closed position and a plurality of open positions. The stop member may be configured to contact the linkage mechanism and the base when the linkage mechanism is in the closed position and prevent relative motion in a first direction between the linkage mechanism and the base.

The linkage mechanism may include a forward pivot link and a rear pivot link. The forward pivot link and the rear pivot link may be pivotally coupled to the base. In some aspects, the stop member may be coupled to the forward pivot link and configured to contact the base when the linkage mechanism is in the closed position. The base may include a mating stop surface configured to contact the stop member when the linkage mechanism is in the closed position. In other aspects, the stop member may be coupled to the base and configured to contact the forward pivot link when the linkage mechanism is in the closed position. The forward pivot link may include a mating stop surface configured to contact the stop member when the linkage mechanism is in the closed position.

In another embodiment, a recliner is described. The recliner may include a right base, a left base, a linkage mechanism, and one or more stop members. The linkage mechanism may be coupled to the right base at a right forward pivot link and a right rear pivot link. The linkage mechanism may be coupled to the left base at a left forward pivot link and a left rear pivot link. The linkage mechanism may be configured to move between a closed position and a plurality of open positions. The one or more stop members are configured to contact the linkage mechanism and contact one of the right base and the left base when the linkage mechanism is in the closed position.

The one or more stop members may comprise a right stop member and a left stop member. The right stop member may be configured to contact the right forward pivot link and the right base and the left stop member may be configured to contact the left forward pivot link and the left base when the linkage mechanism is in the closed position. The right stop member may be a right stop pin coupled to the right forward pivot link. The right stop pin may be configured to contact a right mating stop surface formed on the right base when the linkage mechanism is in the closed position. The right mating stop surface may be integrally formed on the right base. The right stop member may comprise a right stop pin coupled to the right base and configured to contact a right mating stop surface formed on the right forward pivot link when the linkage mechanism is in the closed position. The left stop member may comprise a left stop pin coupled to the left forward pivot link and configured to contact a left mating stop surface formed on the left base when the linkage mechanism is in the closed position. In other aspects, the left stop member may comprise a left stop pin coupled to the left base and configured to contact a left mating stop surface formed on the left forward pivot link when the linkage mechanism is in the closed position.

In another embodiment of the invention, a recline mechanism for use in reclining furniture is described. The recline mechanism may include a base, a forward pivot link pivotally connected to the base, and a pin configured to stop the rotation of the forward pivot link relative to the base when a linkage mechanism is in a closed position. The forward pivot link may be configured to rotate and cause the linkage mechanism to move between the closed position and a plurality of open positions. The pin may be coupled to one of the base and the forward pivot link and contacts the other of the base and the forward pivot link when the linkage mechanism is in the closed position.

The pin may contact a mating stop surface. The mating stop surface may be integrally formed on one of the base and the forward pivot link. In some aspects, the pin may comprise a first pin, and the mating stop surface may comprise a first mating stop surface. In such aspects, the recline mechanism may further comprise a second pin, a second mating stop surface, a third pin, and a third mating stop surface. The second pin and third pin may each be coupled to the linkage mechanism. The second mating stop surface and the third mating stop surface may each be formed on the linkage mechanism. The second pin may contact the second mating stop surface when the linkage mechanism is in the closed position. The third pin may contact the third mating stop surface when the linkage mechanism is in the closed position.

The linkage mechanism may include a bell crank, a connector link, a rear lift link, and a seat plate. The second pin may be coupled to the rear lift link. The second mating stop surface may be formed on the seat plate. The third pin may be coupled to the bell crank. The third mating stop surface may be formed on the connector link. The linkage mechanism may further include a front lift link and a seat plate. The recline mechanism may further include a fourth pin and a fourth mating stop surface. The fourth pin may be coupled to the front lift link. The fourth mating stop surface may be formed on the seat plate. The fourth pin may contact the fourth mating stop surface when the linkage mechanism is in the closed position.

BRIEF DESCRIPTION OF THE DRAWINGS

Illustrative embodiments of the invention are described in detail below with reference to the attached drawing figures, and wherein.

DETAILED DESCRIPTION

Figure 1:
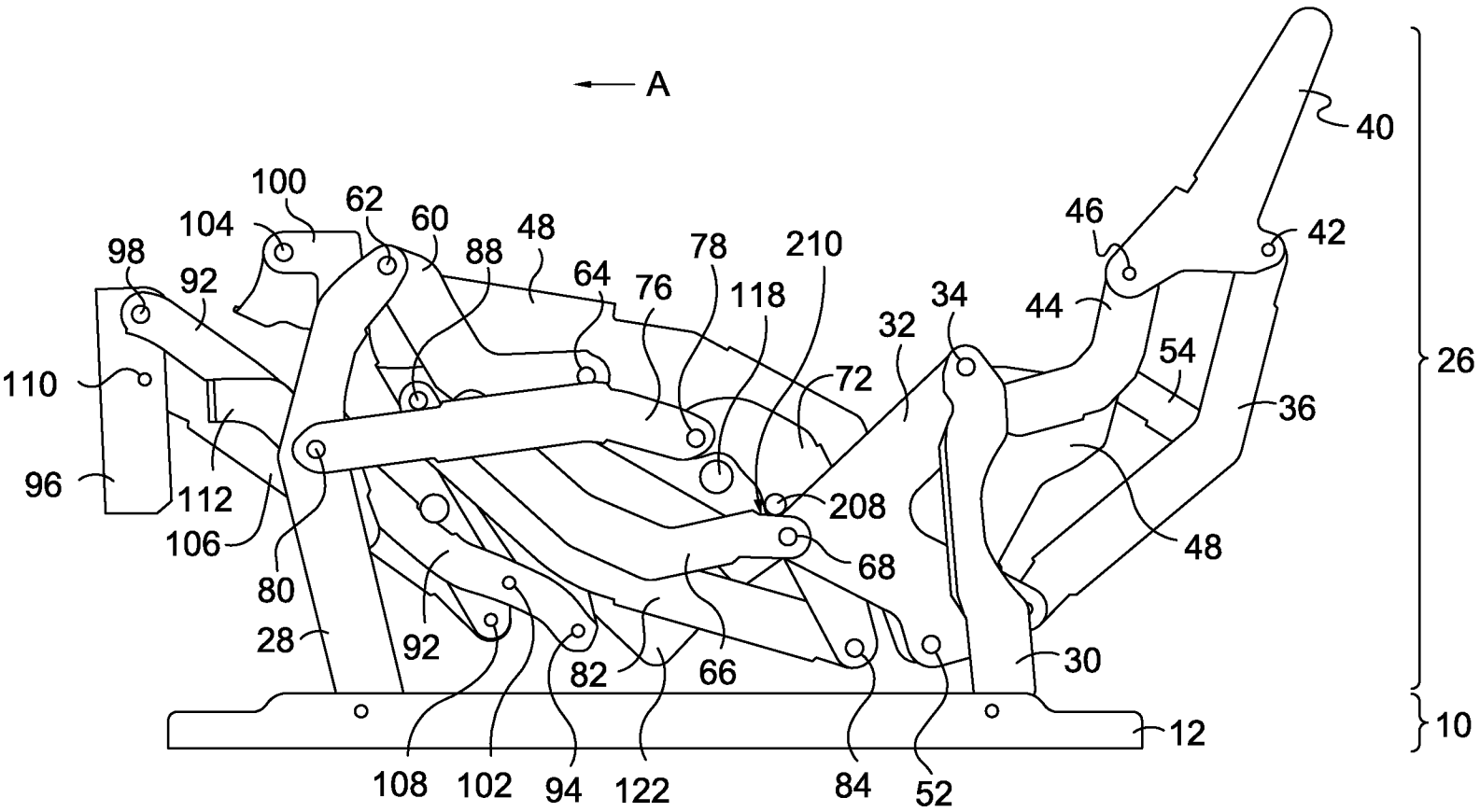
FIG. 1 depicts an inside elevation view of a portion of a manual recline mechanism in a closed position in accordance with an embodiment hereof.

The subject matter of embodiments of the invention is described with specificity herein to meet statutory requirements. But the description itself is not intended to necessarily limit the scope of claims. Rather, the claimed subject matter might be embodied in other ways to include different steps, components, or combinations thereof, in conjunction with other present or future technologies. Terms should not be interpreted as implying any particular order among or between various steps herein disclosed unless and except when the order of individual steps is explicitly described.

Referring to the drawings generally, a portion of a recline mechanism of a recliner is shown in a closed position in accordance with an embodiment of the invention. The recline mechanism couples together a footrest, chair back, chair arms, and a chair seat of a recliner. For the sake of clarity, these portions of the recliner are not shown. The recline mechanism may include a linkage mechanism coupled to a base. Often, the recline mechanism includes a pair of linkage mechanisms (e.g., a left linkage mechanism and a right linkage mechanism) coupled to the base. For clarity, only one linkage mechanism is shown in the figures. In aspects with a pair of mechanisms, the side not shown may be a mirror image of the side that is shown. The illustrated recline mechanism is a manual recline mechanism where a user causes the recliner to move from the closed position to one of a plurality of open positions (e.g., the TV position or the fully reclined position). The following description, however, applies equally to a motorized recline mechanism.

Turning now to FIG. 1, an exemplary recline mechanism is illustrated having a linkage mechanism 26 pivotally coupled to a base 10. The base 10 may comprise a base rail 12 formed from angle steel, as in the illustrated aspect. The base rail 12 supports the linkage mechanism 26 and the remainder of the chair above the surface on which the recliner is placed. In aspects where the recline mechanism includes a pair of linkage mechanisms 26, the base 10 may include a pair of spaced apart base rails 12 coupled to the pair of linkage mechanisms 26. One or more cross-members may connect portions of the base 10 and/or the pair of linkage mechanisms 26. In some aspects, the cross-members are made from angle steel or tubular steel.

Figure 2:
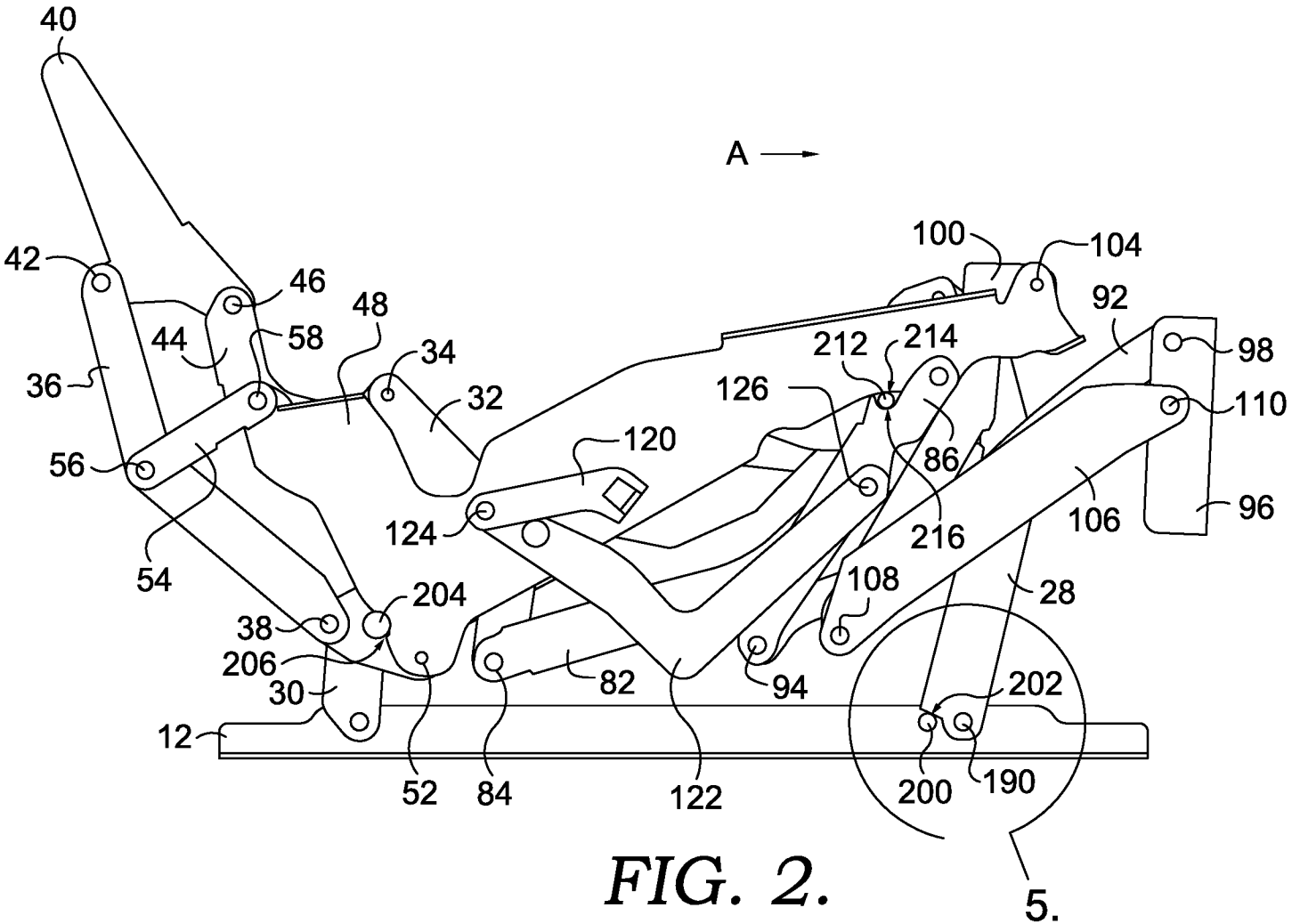
FIG. 2 depicts an outside elevation view of a portion of the recline mechanism from FIG. 1 in the closed position in accordance with an embodiment hereof.

An exemplary linkage mechanism will now be described. In the illustrated embodiment of FIGS. 1 and 2, the linkage mechanism 26 is pivotally coupled to the base rail 12 through a front pivot link 28 and a rear pivot link 30. The front pivot link 28 and the rear pivot link 30 each may rotate generally in direction A to move the recline mechanism from the closed position (shown in FIGS. 1 and 2) to the one or more open positions (e.g., the TV position, the fully-reclined position, or any other open position). The rear pivot link 30 extends upward from the base rail 12. The rear pivot link 30, like the remainder of the links described below, is typically made from steel. The upper, forward end of the rear pivot link 30 is pivotally coupled to a rear lift link 32 at pivot point 34. The rear lift link 32 has a generally triangular shape, as shown. Rearwardly and below pivot point 34 (as viewed in FIGS. 2 and 3), rear lift link 32 is pivotally coupled to a rear back pivot link 36 at pivot point 38. The rear back pivot link 36 extends upward and is pivotally coupled at its opposite end to a back bracket 40 at pivot point 42. The back bracket 40 is shaped as shown, with an upper extending leg that is used to couple the back bracket 40 to a back of the recliner. The forward, lower area of the back bracket 40 is pivotally coupled to an upper end of a forward back pivot link 44 at pivot point 46. The lower end of forward back pivot link 44 is pivotally coupled to a seat mounting plate 48 at pivot point 50 (as viewed in FIG. 3). The rear lift link 32 is also coupled to the seat mounting plate 48 at pivot point 52, which is below pivot point 50. As best seen in FIG. 2, a rearward end of a control link 54 is pivotally coupled to the rear back pivot link 36 at intermediate pivot point 56. The forward end of the control link 54 is pivotally coupled to the seat mounting plate 48 at pivot point 58, which is rearward of pivot point 50 (as viewed in FIG. 3).

Returning to FIG. 1, the front pivot link 28 extends upward from the base rail 12. The upper end of the front pivot link 28 is pivotally coupled to a front lift link 60 at pivot point 62. Rearwardly of pivot point 62, the front lift link 60 is pivotally coupled to the seat mounting plate 48 at pivot point 64. A connector link 66 is pivotally coupled on one end to the rear lift link 32 at pivot point 68. The connector link 66 is pivotally coupled on the other end to the front lift link 60 at intermediate pivot point 70 (as viewed in FIG. 3).

Figure 3:
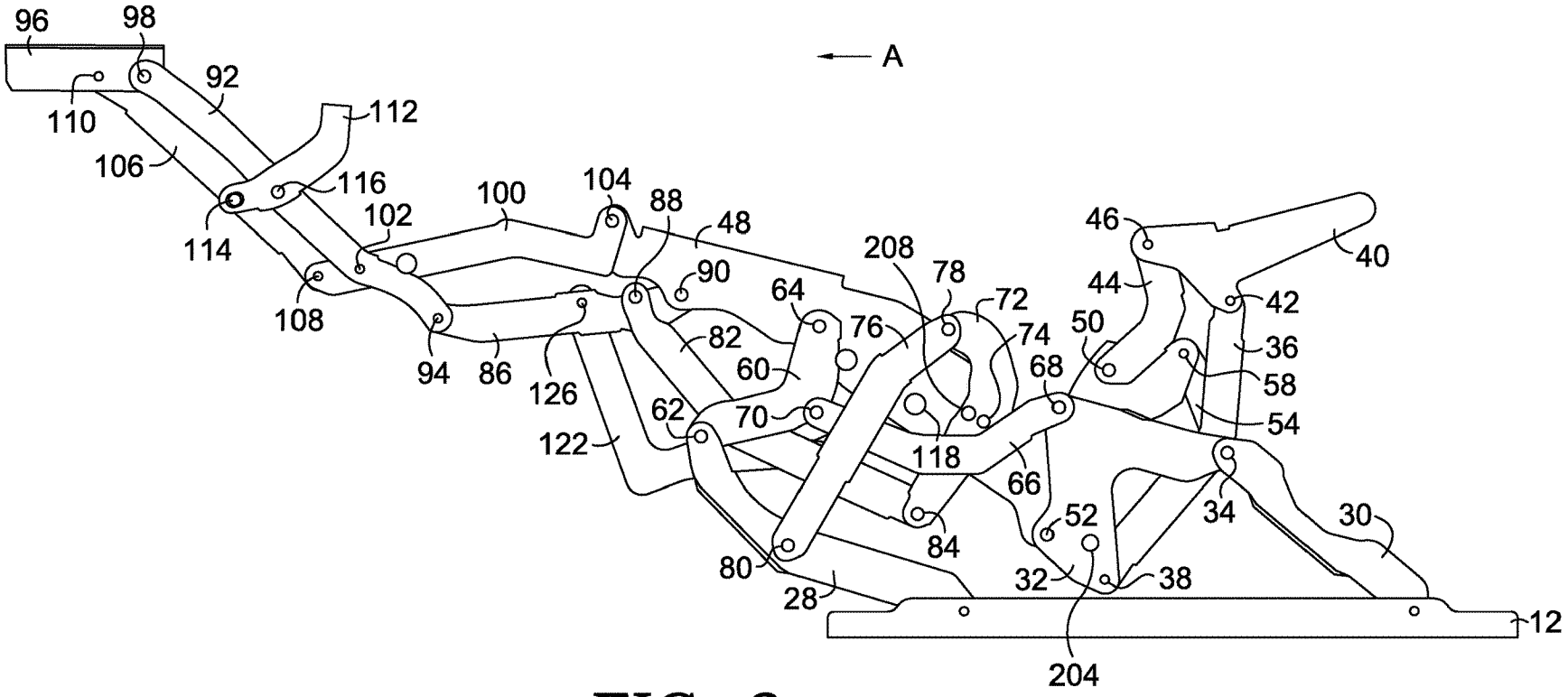
FIG. 3 depicts an inside elevation view of a portion of the recline mechanism from FIG. 1 in a fully reclined position in accordance with an embodiment hereof.

Referring to FIG. 3, a bell crank 72 is pivotally coupled to the seat mounting plate 48 at pivot point 74. The bell crank 72 is shaped as shown, having pivot point 74 at an intermediate position between a first end and a second end. The first end of the bell crank 72 extends upwardly from pivot point 74 and is pivotally coupled to a rear end of a crank connector link 76 at pivot point 78. A front end of the crank connector link 76 is pivotally coupled to the front pivot link 28 at intermediate pivot point 80. The second end of the bell crank 72 extends downwardly from pivot point 74 and is pivotally coupled to a footrest drive link 82 at pivot point 84. The footrest drive link 82 extends from the connection to the bell crank 72 forwardly and is pivotally coupled on its forward end to a rear ottoman link 86 at intermediate pivot point 88. The rear ottoman link 86 is pivotally coupled on its rear, upper end to the seat mounting plate 48 at pivot point 90. The opposite end of the rear ottoman link 86 is pivotally coupled to a main ottoman link 92 at pivot point 94. In the fully reclined position, the main ottoman link 92 extends upwardly and forwardly from the rear ottoman link 86. The upward, forward end of the main ottoman link 92 is pivotally coupled to an ottoman bracket 96 at pivot point 98. Additionally, the main ottoman link 92 is pivotally coupled, at an intermediate point, to a front ottoman link 100 at pivot point 102. The front ottoman link 100 is pivotally coupled on one end to the seat mounting plate 48 at pivot point 104, and is pivotally coupled on the other end to a shielded ottoman link 106 at pivot point 108. The shielded ottoman link 106 is pivotally coupled on its other end to the ottoman bracket 96 at pivot point 110. An intermediate point of the shielded ottoman link 106 is pivotally and slidably coupled to a mid-ottoman bracket 112 at slidable pivot point 114. A mid-point of the mid-ottoman bracket 112 is pivotally coupled, at an intermediate point, to the main ottoman link 92 at pivot point 116.

The recline mechanism described above can be implemented as a motorized or manual version, depending on the desired end use. As a manual version, a drive tube (not shown) is pivotally coupled to the seat mounting plate 48 at pivot point 118 (as viewed in FIG. 1). The drive tube is controlled by a lock mechanism. The lock mechanism includes a lock bracket 120 and a lock link 122, best seen in FIG. 2. The lock bracket 120 is coupled on one end to the drive tube and configured to operatively lock the recline mechanism in the closed position (shown in FIGS. 1 and 2). The other end of the lock bracket 120 is pivotally coupled to a rear end of the lock link 122 at pivot point 124. The front end of the lock link 122 is pivotally coupled, generally at a mid-point, to the rear ottoman link 86 at pivot point 126.

Figure 4:
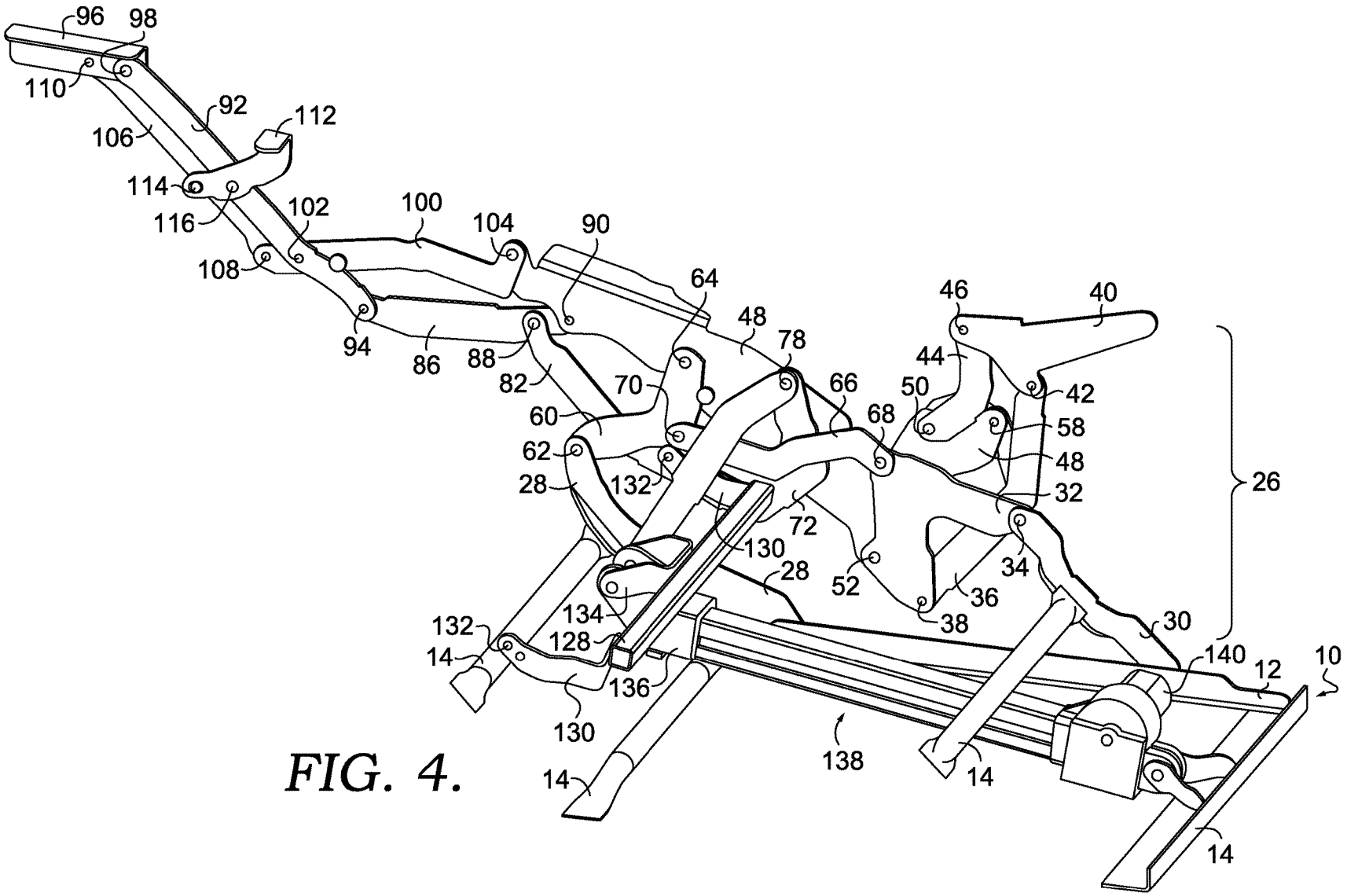
FIG. 4 depicts a perspective view of a portion of a motorized recline mechanism in a fully reclined position in accordance with an embodiment hereof.

Referring to FIG. 4, as a motorized version, a motor tube 128 is secured to and between the footrest drive links 82. More specifically, a motor tube bracket 130 is fixedly secured to the footrest drive link 82 at coupling point 132. The opposite end of the motor tube bracket 130 is fixedly coupled to the motor tube 128, such as by welding. A clevis 134 is fixedly coupled to the motor tube 128 midway along the motor tube 128, facilitating a pivotal coupling to one end of a motor driven trolley 136. The trolley 136 rides along a track 138. The track 138 is supported on a front end by the trolley 136 and on the opposite end by one of the cross members 14 to which the track 138 is fixedly coupled. A motor 140 drives the trolley 136 along the track 138 and holds the trolley 136 at positions associated with the recline mechanism being in at least the closed position, the TV position, and the fully reclined position.

Figure 5:
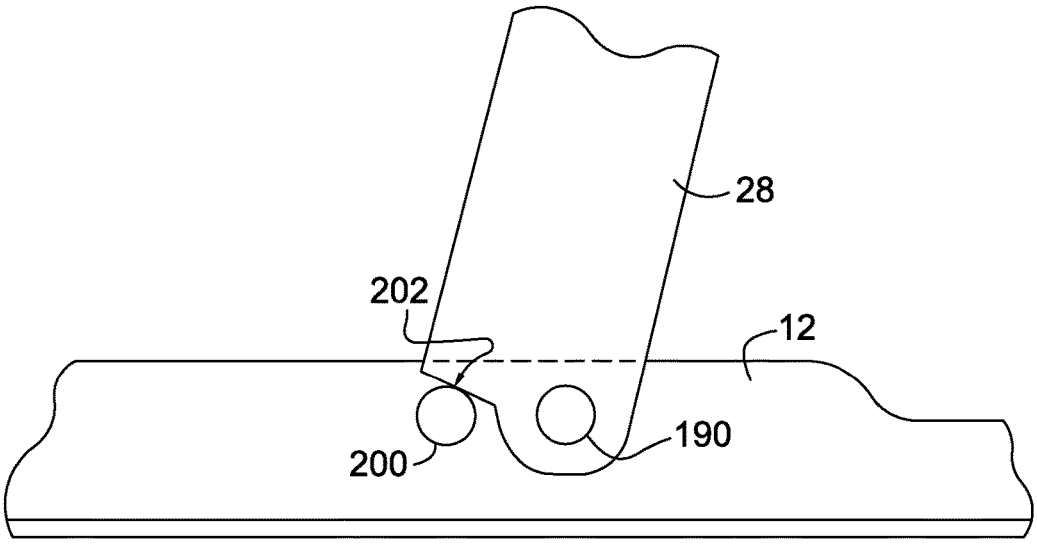
FIG. 5 depicts a section view taken along cut line 5-5 in FIG. 2 showing a coupling between a base rail and a front pivot link in accordance with an aspect hereof.
Figure 6:
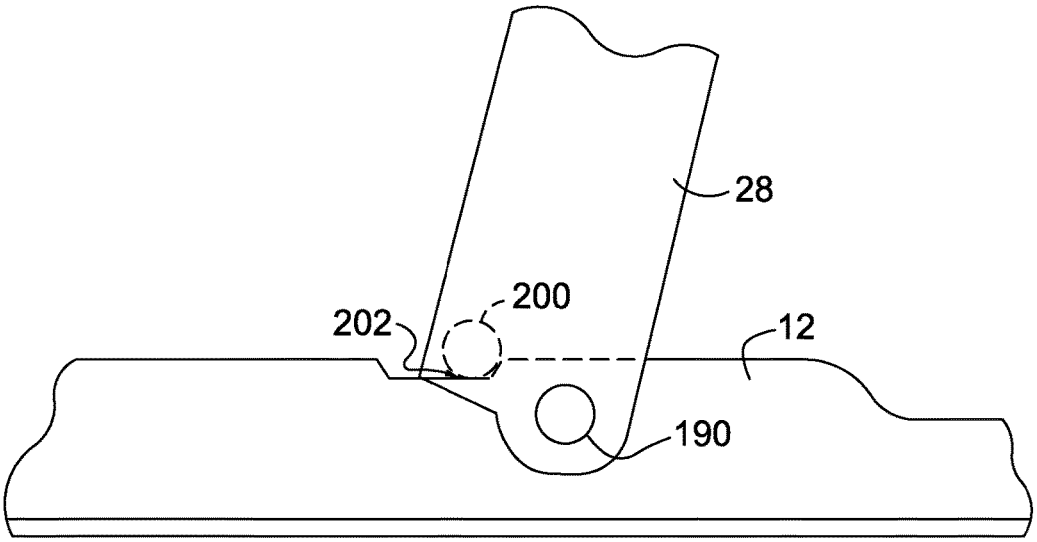
FIG. 6 depicts a section view showing an alternative configuration of the base rail and front pivot link shown in FIG. 5 in accordance with an embodiment hereof.

Turning now to FIGS. 5 and 6, section views of alternative pivotal connections between the front pivot link 28 and the base rail 12 at pivot point 190 is depicted. In some embodiments of the recline mechanism, a stop member 200 is coupled to the base rail 12 as viewed in FIG. 5. The stop member 200 may comprise a pin, in accordance with some aspects. In other aspects, the stop member 200 may comprise a bushing. When the recline mechanism is in the closed position, the front pivot link 28 contacts the stop member 200 and the front pivot link 28, and thus the recline mechanism is prevented from moving in the rearward direction passed the closed position. In some aspects, the front pivot link 28 may include a mating stop surface 202. The stop member 200 may contact the mating stop surface 202 when the recline mechanism is in the closed position. The mating stop surface 202 may be integrally formed on the front pivot link 28. In another embodiment of the recline mechanism shown in FIG. 6, the stop member 200 may be coupled to the front pivot link 28. In such embodiments, the stop member 200 contacts the base rail 12 when the recline mechanism is in the closed position preventing the front pivot link 28 and therefore the recline mechanism from moving in the rearward direction passed the closed position. Further, in such embodiments, the mating stop surface 202 may be formed on the base rail 12.

In still other embodiments, the linkage mechanism 26 includes one or more additional stop members that work in cooperation to hold the recline mechanism in the closed position. For example, the exemplary linkage mechanism illustrated in FIGS. 1-3 includes a second stop member 204 (as viewed in FIG. 2), a third stop member 208 (as viewed in FIG. 1), and a fourth stop member 212 (as viewed in FIG. 2). The second stop member 204 is coupled to the rear lift link 32 and is configured to contact the seat mounting plate 48 when the recline mechanism is in the closed position. In some aspects, a second mating stop surface 206 (as viewed in FIG. 2) may be formed on the seat mounting plate 48. The second stop member 204 may contact the second mating stop surface 206 when the recline mechanism is in the closed position. The third stop member 208 is coupled to a middle portion of the bell crank 72 and is configured to contact the connector link 66 when the recline mechanism is in the closed position. In some aspects, a third mating stop surface 210 (as viewed in FIG. 1) may be formed on the connector link 66. The third stop member 208 may contact the third mating stop surface 210 when the recline mechanism is in the closed position. The fourth stop member 212 is coupled to the front lift link 60 and is configured to contact the seat mounting plate 48 when the recline mechanism is in the closed position. In some aspects, a fourth mating stop surface 214 (as viewed in FIG. 2) may be formed on the seat mounting plate 48. The fourth stop member 212 may contact the fourth mating stop surface 214 when the recline mechanism is in the closed position, which prevents the front lift link 60 from rotating forwardly. In other aspects, a fifth mating stop surface 216 (as viewed in FIG. 2) may be formed on the rear ottoman link 86. The fourth stop member 212 may contact the fifth mating stop surface 216 when the recline mechanism is in the closed position, which prevents the front lift link 60 from rotating rearwardly. Although not illustrated in the figures, the fifth mating stop surface may alternatively be formed on the footrest drive link 82 rather than on the rear ottoman link 86.

In operation, when a user sits in the recliner when the recline mechanism is in the closed position a load is applied to the recliner. If there is slack in the recline mechanism, the seat of the recliner may move when carrying the user's load. The seat of the recliner cannot move, however, when the front pivot link 28 cannot move. The front pivot link 28 cannot move when the stop member 200 is used. Hence, the stop member 200 reduces or eliminates slack in the recline mechanism and reduces or eliminates slack in the seat of the recliner. That is, the stop member 200 controls front to rear movement of the front pivot link 28 and therefore the rear pivot link 30 when the recline mechanism is in the closed position.

In the exemplary linkage mechanism illustrated in FIGS. 1-3, the second stop member 204 controls the forward rotation of the rear lift link 32 and the chair back. The third stop member 208 controls the rearward rotation of the rear lift link 32 and the chair back. The fourth stop member 212 controls the rearward rotation of the front lift link 60, the rear lift link 32, and the chair back and also prevents up and down movement of the seat in a direction normal to the surface the chair is supported upon.

The exemplary arrangement of the above described stop members 200, 204, 208, and 212 provide a more positive way of preventing movement (i.e., slack) of the recline mechanism, and more particularly, the links of the linkage mechanism when in the closed position. This exemplary arrangement provides this improved way of preventing movement without adding excess loading of the rivet joints to prevent the movement. Excess loading of the rivet joints increases the force required to close the recline mechanism, which is a problem from which prior methods have suffered.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A reclining mechanism comprising:

a base;

a linkage mechanism operatively coupled to the base, the linkage mechanism configured to move between a closed position and a plurality of open positions;

a stop member configured to contact the linkage mechanism and the base when the linkage mechanism is in the closed position, wherein the linkage mechanism includes a forward pivot link and a rear pivot link, the forward pivot link and the rear pivot link pivotally coupling the linkage mechanism to the base, wherein the stop member is coupled to the forward pivot link and is configured to contact the base when the linkage mechanism is in the closed position.

2. The recline mechanism of claim 1, wherein the base includes a mating stop surface configured to contact the stop member when the linkage mechanism is in the closed position.

3. A recliner comprising:

a right base;

a left base;

a linkage mechanism coupled to the right base at a right forward pivot link and a right rear pivot link, the linkage mechanism coupled to the left base at a left forward pivot link and a left rear pivot link, the linkage mechanism configured to move between a closed position and a plurality of open positions; and one or more stop members configured to contact the linkage mechanism and contact one of the right base and the left base when the linkage mechanism is in the closed position.

4. The recliner of claim 3, wherein the one or more stop members comprise a right stop member and a left stop member, the right stop member configured to contact the right forward pivot link and the right base and the left stop member configured to contact the left forward pivot link and the left base when the linkage mechanism is in the closed position.

5. The recliner of claim 4, wherein the right stop member comprises a right stop pin coupled to the right forward pivot link and configured to contact a right mating stop surface formed on the right base when the linkage mechanism is in the closed position.

6. The recliner of claim 5, wherein the right mating stop surface is integrally formed on the right base.

7. The recliner of claim 4, wherein the right stop member comprises a right stop pin coupled to the right base and configured to contact a right mating stop surface formed on the right forward pivot link when the linkage mechanism is in the closed position.

8. The recliner of claim 4, wherein the left stop member comprises a left stop pin coupled to the left forward pivot link and configured to contact a left mating stop surface formed on the left base when the linkage mechanism is in the closed position.

9. The recliner of claim 4, wherein the left stop member comprises a left stop pin coupled to the left base and configured to contact a left mating stop surface formed on the left forward pivot link when the linkage mechanism is in the closed position.

10. A recline mechanism comprising:

a base;

a forward pivot link pivotally connected to the base, the forward pivot link configured to rotate and cause a linkage mechanism to move between a closed position and a plurality of open positions;

a pin configured to stop the rotation of the forward pivot link relative to the base when the linkage mechanism is in the closed position, wherein the pin is coupled to one of the base and the forward pivot link and contacts the other of the base and the forward pivot link when the linkage mechanism is in the closed position.

11. The recline mechanism of claim 10, wherein the pin contacts a mating stop surface, wherein the mating stop surface is integrally formed on one of the base and the forward pivot link.

12. The recline mechanism of claim 11, wherein the pin comprises a first pin and the mating stop surface comprises a first mating stop surface, the recline mechanism further comprising:

a second pin coupled to the linkage mechanism;

a second mating stop surface formed on the linkage mechanism, the second pin contacting the second mating stop surface when the linkage mechanism is in the closed position;

a third pin coupled to the linkage mechanism; and a third mating stop surface formed on the linkage mechanism, the third pin contacting the third mating stop surface when the linkage mechanism is in the closed position.

13. The recline mechanism of claim 12, wherein the linkage mechanism has a bell crank, a connector link, a rear lift link and a seat plate.

14. The recline mechanism of claim 13, wherein the second pin is coupled to the rear lift link and the second mating stop surface is formed on the seat plate.

15. The recline mechanism of claim 13, wherein the third pin is coupled to the bell crank and the third mating stop surface is formed on the connector link.

16. The recline mechanism of claim 12, further comprising:

the linkage mechanism having a front lift link and a seat plate, a fourth pin coupled to the front lift link;

a fourth mating stop surface formed on the seat plate, the fourth pin contacting the fourth mating stop surface when the linkage mechanism is in the closed position.

17. A reclining mechanism comprising:

a base;

a linkage mechanism operatively coupled to the base, the linkage mechanism configured to move between a closed position and a plurality of open positions;

a stop member configured to contact the linkage mechanism and the base when the linkage mechanism is in the closed position, wherein the linkage mechanism includes a forward pivot link and a rear pivot link, the forward pivot link and the rear pivot link pivotally coupling the linkage mechanism to the base, wherein the stop member is coupled to the base and is configured to contact the forward pivot link when the linkage mechanism is in the closed position.

18. The recline mechanism of claim 17, wherein the forward pivot link includes a mating stop surface configured to contact the stop member when the linkage mechanism is in the closed position.

* * * * *